United States Patent [19]

Griffiths

[11] 4,022,447

[45] May 10, 1977

[54] SUPERSONIC NOZZLE FOR SUBMERGED TUYERE OXYGEN STEELMAKING PROCESS

[75] Inventor: David K. Griffiths, Penn Hills Township, Allegheny County, Pa.

[73] Assignee: United States Steel Corporation, Pittsburgh, Pa.

[22] Filed: Feb. 23, 1976

[21] Appl. No.: 660,567

[52] U.S. Cl. ..... 266/266; 266/222

[51] Int. Cl.[2] ..... C21C 5/48

[58] Field of Search ..... 266/209–210, 266/216–218, 221–226, 265–268, 270

[56] References Cited

UNITED STATES PATENTS

| | | | |
|---|---|---|---|
| 295,545 | 3/1884 | Griffiths | 266/223 |
| 3,627,295 | 12/1971 | Doi et al. | 266/225 |
| 3,843,105 | 10/1974 | Chang | 266/226 |
| 3,892,393 | 7/1975 | Carroll | 266/225 |
| 3,898,078 | 8/1975 | Huber | 266/225 |

FOREIGN PATENTS OR APPLICATIONS

| | | | |
|---|---|---|---|
| 216,032 | 7/1961 | Austria | 266/225 |

*Primary Examiner*—Gerald A. Dost
*Attorney, Agent, or Firm*—Arthur J. Greif

[57] ABSTRACT

A tuyere assembly is provided which is especially useful in pneumatic steelmaking processes employing submerged blowing. This improved tuyere provides oxidizing or other gases at supersonic velocities while concomitantly employing pressures only slightly above that of the metal bath. Such supersonic velocities are achieved by the insertion, into a conventional tuyere, of a generally pear-shaped, double-cone object so as to provide a limiting throat section followed by an expansion chamber which permits the gases to exceed sonic velocity. By achieving supersonic velocities without the use of high inlet pressures, (i) a material decrease in refractory wear is achieved and (ii) higher gas flow rates are permitted without the occurrence of "spitting".

4 Claims, 1 Drawing Figure

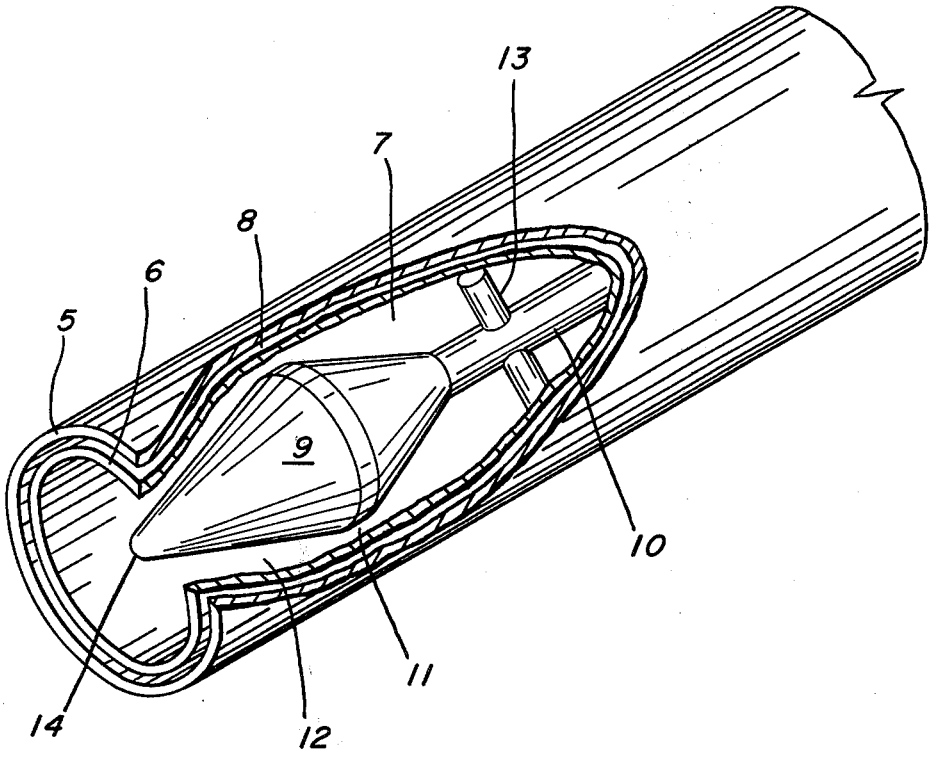
13
7
8
6
5
9
10
11
14
12

SUPERSONIC NOZZLE FOR SUBMERGED TUYERE OXYGEN STEELMAKING PROCESS

This invention relates to pneumatic methods and apparatus for the production of steel and is more particularly related to steelmaking processes utilizing submerged tuyere blowing, e.g. the well-known Bessemer process, as well as the newer processes such as the Q-BOP, SIP and the AOD process for the production of stainless grades.

All submerged blowing processes have one element in common. Oxygen or other gas, and in some instances fluxes in the form of particulate matter, are blown through a central bore of one or more tuyeres mounted in the bottom or the side wall of the steelmaking vessel. The newer processes employ tuyere with two or more concentric tubes in which the annular orifice, formed between the tubes, is employed for the injection of an auxiliary or jacket gas which does not react, or reacts only slowly with the molten metal bath. In the Q-BOP and SIP the jacket gas acts to reduce the rate of reaction between the molten metal and the oxygen from the adjacent tuyere, preventing rapid erosion of the tuyere, reducing the rate of erosion of the lining of the vessel and reducing scorching of the vessel mouth. Desirably, as a result of utilization of such jacket gas, the furnace lining and the tuyere will wear at about the same rate. Since the tuyere design is complex and the mounting of the tuyeres in the refractory lining of brick requires special brick shapes, the number of tuyeres for injection of the oxygen is generally made as small as possible. For this reason oxygen is supplied to the tuyeres at high pressure resulting in near sonic oxygen velocities in the tuyeres. The oxygen leaving the egress end of the tuyere at close to sonic velocity is at a pressure considerably higher than the average ferrostatic pressure of the bath at the region of the tuyere. In general, oxygen pressures of the order of 5 – 8 atmospheres have been employed whereas the ferrostatic pressure of the bath will be of the order of about 2 atmospheres. In addition to this initial pressure differential, the change of temperature of the gas from its normal supply temperature to the significantly higher steelmaking temperature will provide a significant (eg. about five-fold) increase in the pressure of the entering gas. The resulting expansion of the gas, after leaving the egress end of the nozzle, may be described as explosive, with high flow velocities that are detrimental to the refractories. These two factors, the initial pressure differential and the further expansion of the gas are a prime cause of refractory wear. Clearly, this wear could be significantly reduced if the gas were to enter at a pressure only slightly above that of the metal bath ambient the tuyere tip. Unfortunately, if the pressure differentials are materially reduced while using conventional tuyeres, desired penetration of the metal bath with the oxygen refining gas will not be achieved. To achieve desired penetration with very low pressure differentials, the velocity of the gas must therefore be supersonic. At first blush, it would appear that the well known DeLaval-type nozzle, see for example U.S. Pat. No. 3,015,481, could be employed on the end of the tuyere to control the gas pressure and velocity. However, the use of such a DeLaval nozzle will generally be impractical; since, as seen below, proper design of such a nozzle dictates that the length of the diverging part thereof, be rather short, i.e. < 1 inch. Since the tuyere is slowly burned back with normal wear during a vessel campaign, the pressure of the gas exiting such a short nozzle would continually increase while its respective velocity would decrease. As a result of such burn back, the DeLaval nozzle would soon begin to act a conventional straight bore nozzle.

A supersonic DeLaval nozzle consists of a converging flow passage followed by a diverging flow passage, forming a constriction or throat between them. The passages are usually of circular cross-section. Gas at a high pressure increases in velocity as it flows through the converging passage, reaching sonic velocity at the throat. Theoretically, the gas pressure in the throat is a fixed fraction of the pressure of the gas approaching the nozzle (if the approach velocity is low) and is given by the equation:

$$p_t = p_1 \left(\frac{2}{k+1}\right)^{\frac{k}{k-1}} \quad (= 0.5283\ p_1 \text{ for oxygen}) \qquad (1)$$

where $p_t$ is the gas pressure in the throat $p_l$ is the gas pressure before the nozzle k is the ratio of the specific heat of the gas at constant pressure to the specific heat of the gas at constant volume ($k = 1.40$ for oxygen)

The gas expands as it passes through the diverging portion of the nozzle, increasing in velocity and decreasing in pressure.

As noted above, it is desirable that the diverging portion of the nozzle (egress end) terminate at the position at which the nozzle pressure is about equal to the ambient bath pressure. Theoretically, the ratio of the cross-section area of the throat to the cross-section area of the mouth of the diverging part of the nozzle is given by the equation:

$$\frac{A_t}{A_2} = \left(\frac{k+1}{2}\right)^{\frac{1}{k-1}} \left(\frac{p_2}{p_1}\right)^{\frac{1}{k}} \sqrt{\frac{k+1}{k-1}\left[1-\left(\frac{p_2}{p_1}\right)^{\frac{k-1}{k}}\right]} \qquad (2)$$

where

At is the cross-section area of the throat $A_2$ is the cross-section area of the mouth of the diverging part of the nozzle $k$ is the ratio of the specific heat of the gas at constant volume $p_1$ is the absolute pressure of the gas before the nozzle $p_2$ is the absolute ambient pressure If the mouth of the nozzle is made too small, the gas will leave the nozzle at a pressure above the ambient pressure and continue to expand outside the nozzle with no further increase in velocity. If the mouth of the nozzle is made too large, the gas will tend to overexpand leaving the nozzle at a pressure below ambient pressure and cause shock waves which dissipate energy.

The above equations assume isentropic flow of the gas, with no friction or boundary layer drag at the walls of the nozzle. Because there is friction and boundary layer effects at the walls of the nozzle, the cross-section area of the mouth of real nozzles are generally made 5 to 10 percent smaller in area than the theoretical value. For the same reason, the length of the nozzle should not be excessively long. A divergent cone half angle of from 12° to 18° has been found experimentally to be optimum for conventional DeLaval nozzles.

Using equation 2 for a DeLaval nozzle on a 1.5-inch diameter tuyere and assuming the absolute pressures of the oxygen supply to be 8 atmosphere and that due to the ferrostatic head to be 2 atmospheres, the throat would be 1.36 inches in diameter and the length of the diverging part of the DeLaval nozzle would be 0.33 inch long if the half angle was 12° . As with conventional tuyeres, such a nozzle located at the end of a Q-BOP tuyere would be burned away along with the normal erosion of the bottom of the vessel. As the tuyere began to burn back, the gas would leave the nozzle at higher and higher pressure and at concomitantly decreasing velocities. When the tuyere burned back to the throat, the pressure of the gas leaving the tuyere would be higher than that through a straight bore tuyere operating at the same gas flow rate.

It is therefore a principle object of this invention to provide a new tuyere system capable of achieving high oxygen jet penetration while employing gaseous inlet pressures only slightly above that of the metal bath ambient the tuyere tip.

It is a further object of this invention to provide a method and apparatus capable of materially reducing refractory wear and the tendency to spitting.

These and other objects and advantages of the invention will better be understood by reference to the following description, the appended claims and the accompanying drawing, in which;

The FIGURE is a representational drawing showing the essential features of the tuyere of this invention.

Referring to the Figure, it may be seen that the invention consists of a shaped body positioned within the central bore of the tuyere. The shaped body may be in the form of a conoid (not shown) or a double conoid, as shown by the Figure. The positioning of the conoid within the bore will result in the formation of a limiting throat section 11 followed by an expansion chamber 12, in which the gas is permitted to exceed sonic velocity. As depicted, the tuyere is constructed of two concentric pipes 5 and 6, in which the annular passage therebetween 8, may be employed for the use of coolant or other auxiliary gases. It should be understood, however, that the basic concept of this invention may be employed for use in processes such as the Bessemer in which there will be no need for provision of such an annular passage. In the depicted tuyere, which is especially useful for Q-BOP, oxygen is supplied at high pressures, e.g. in the range of 50 to 250 lbs/in$^2$ through the central passage 7 while an auxiliary gas such as methane or argon is supplied through annular passage 8. The oxygen pipe 6 is desirably constructed of copper, stainless steel, or other well-known materials that are resistant to oxidation at high oxygen pressures. By contrast, the outer pipe 5, if employed, may be composed of ordinary carbon steel. The shaped body 9 is initially positioned near the end of the tuyere nozzle and is maintained in that position by rod 10 which extends the length of the tuyere and through the ingress end of the tuyere by means of conventional O-ring seals where it may be clamped in position (not shown). The insert member 9 is preferably tapered at both ends, as shown. However, it is only necessary to provide for a taper toward the egress end of the tuyere, so as to provide an annular throat area 11 which the oxygen may approach sonic velocity. Thereafter, the oxygen passes into expansion chamber 12, created by the taper of the insert member, the reduced pressure therein permitting expansion of the oxygen so as to exceed sonic velocity. Desirably, the ratio of the throat area to that of the mouth or egress orifice area is such that the pressure of the gas at the egress end of the orifice is only slightly above that of the molten bath contiguous to said orifice, so as to avoid the undesirable effects of increased refractory wear and/or spitting, as discussed hereinabove. The ratio of the throat area $A_T$, to the tuyere egress orifice area $A_2$, may similarly be determined by use of equation 2.

It is preferable that the shaped body be supported in a central position within the bore of the tuyere. This may be effected, for example, by supporting the positioning rod near the ingress end of the tuyere so as to concomitantly achieve central positioning of the insert member itself. The Figure illustrates another means for achieving such positioning, through the use of spacers 13 located on the positioning rod itself. Desirably, the insert member and the positioning rod will be made of a highly conductive material, such as copper. Thus, in the event that molten metal may enter the tuyere, such as a result of sudden failure in the gas supply pressure, the highly conductive insert member and the positioning rod would act as a quenching system and prevent molten metal from flowing further through the tuyere.

Since the supersonic velocity and decreased gas pressure is attained towards the tip of the shaped body, considerable leeway is permitted in the longitudinal (axial direction) positioning of the insert member within the tuyere itself. Preferably, the shaped body is positioned so that the tip 14 (of the tapered end located within the egress end of the tuyere) lies approximately in the plane, perpendicular to the bore axis, formed by the end of the tuyere. In order to avoid loss of gas velocity due to friction, it is also desirable that the tip 14 not be recessed by more than about 2 tuyere diameters from that plane. Thus, for a supersonic 1.5-inch-(I.D.) tuyere constructed according to this invention, and for the operating conditions previously considered, i.e., oxygen at an obsolute pressure of 8 atmospheres and a ferrostatic head equivalent to an absolute pressure of 2 atmospheres, the body diameter of the insert member (forming the annular throat) would be about 0.63 inches. A half angle of 12° would make the diverging part of the nozzle about 1.5 inches long. However, if one were to utilize such a length, wall friction might be excessive. Therefore, a larger half angle of 18° (~1.0 inch divergent section length) to 20° (0.87 inch divergent section length) would be preferable. A larger half angle might lead to flow separation and shock waves. These suggested half angle limits are preferred, only for the attainment of greatest velocity for an available oxygen pressure. Wall friction and shock waves within the tuyere are not deleterious to it or to the process, but only represent a loss of energy that is not transformed into gas velocity, thereby resulting in loss of efficiency.

I claim:

1. In a tuyere, having a central straight bore for the injection of refining gases into molten metal, said tuyere being adapted for submerged blowing, wherein during refining, the egress end of said bore contacts the molten metal, the improvement which comprises, a generally conoidal insert member supported in an approximately axial position within, but not contiguous to the surface of said bore, in which (i) the base portion of the conoid is located upstream of the tapered portion thereof, and (ii) the downstream end of said insert member lies approximately in the plane formed by the egress end of the tuyere whereby the cross-sectional area of the annular passageway formed by the surface of the bore and the outer surface of said conoid exhibits a minimum at the base portion and increases in the direction of travel of said refining gases, said cross-sectional area being measured in a plane perpendicular to the bore axis, positioning means for moving said insert member in an axial direction within said bore, support means, located upstream of said base member, for maintaining the insert member in said approximately axial position.

2. The tuyere of claim 1, in which said insert member is composed of two conoidal members, the bases of which are contiguous and essentially congruent, so as to provide a generally pear-shaped configuration.

3. The tuyere of claim 2, in which said insert member is composed of a metal having a conductivity substantially equal to or superior to that of copper.

4. The tuyere of claim 1, including a vessel for the refining of molten metal, said tuyere being mounted in the bottom of said vessel.

* * * * *